United States Patent [19]

Michit

[11] Patent Number: 4,597,706

[45] Date of Patent: Jul. 1, 1986

[54] PROCESS AND MACHINE TO MECHANICALLY PICK UP, STORE AND PLACE HOLLOW CONE MARKERS USED AS LANE GUIDES

[76] Inventor: Emile J. Michit, 24, rue de la Poste, 13690 - Graveson, France

[21] Appl. No.: 674,502

[22] Filed: Nov. 23, 1984

[30] Foreign Application Priority Data

Dec. 13, 1983 [FR] France ..... 83 20084

[51] Int. Cl.[4] ..... B65G 57/03; B65G 59/10; B65G 59/12; B65G 65/06

[52] U.S. Cl. ..... 414/30; 198/416; 198/510.1; 414/37; 414/47; 414/91; 414/126; 414/505; 414/523; 414/528; 414/786; 221/110

[58] Field of Search ..... 414/30, 37, 47, 78, 414/126, 467, 501, 505, 507, 523, 528, 786, 91; 198/416, 510, 651, 510.1, 803.12; 248/131, 137, 140; 221/110

[56] References Cited

U.S. PATENT DOCUMENTS 3,157,267 11/1964 Asbury ..... 414/528 X
3,268,052 8/1966 Asbury ..... 414/523 X
3,750,900 8/1973 Piercey ..... 414/30
3,926,319 12/1975 Neely ..... 414/44 X

FOREIGN PATENT DOCUMENTS 2747183 4/1978 Fed. Rep. of Germany .

*Primary Examiner*—Joseph E. Valenza
*Assistant Examiner*—Stuart J. Millman
*Attorney, Agent, or Firm*—Balogh, Osann, Kramer, Dvorak, Genova & Traub

[57] ABSTRACT

The object of this invention is a machine which automatically collects hollow conical road markers, stores them, transports them and dispenses them in a line. This machine is comprised of a vehicle carrying a series of vertical cylindrical magazines open at both ends which are supported by a vertical central shaft which rotates them stepwise (into position). The machine includes a device which collects the cone markers comprised of a chain elevator having projections each of which penetrates one cone marker.

When the chain reaches the top, the cone marker is released into the top of the magazine where they pile up one on top of the other.

10 Claims, 6 Drawing Figures

PROCESS AND MACHINE TO MECHANICALLY PICK UP, STORE AND PLACE HOLLOW CONE MARKERS USED AS LANE GUIDES

The object of the invention is a process and a machine to mechanically pick up, store and place hollow conical road markers.

The technical section of the invention concerns the construction of the machines. Up until now a machine capable of mechanically picking up, storing and setting down in a line hollow conical road markers which are currently utilized to mark off a work zone on a road or high-way or to signal the presence of an obstacle or to separate two lanes of traffic, is unknown.

The objective of the present invention is to provide the means, notably a motorized or towed machine, permitting the fulfillment of these operations.

This objective is achieved by a process according to which a vehicle carrying vertical cylindrical magazines which are open at both ends and which are attached to a central vertical shaft which shifts them one after another, is moved along a line of cone markers:

to pick up the said cone markers, they are aligned then tipped forward by means of a device carried on the vehicle, then they are lifted by means of a conveyor having projections which penetrate into each cone marker and ejects them at the top of the conveyor into an inclined gullet at the upper end of the said magazines;

and to distribute the said cone markers, one of the magazines is brought over an inclined gullet and the cone markers are released one by one.

A machine according to the invention includes several vertical cylindrical magazines open at both ends which are supported by horizontal arms which link them to a central vertical shaft which is mounted on a motorized or towed vehicle, and the means to advance the said shaft step by step, each step corresponding to the angular distance between two adjacent magazines.

A machine according to the invention includes a device for picking up the cone markers comprised of a chain conveyor elevator which is situated on one side of the vehicle, the said conveyor has articulated projections on a closed chain which penetrate into each cone marker and, in addition, the collection device includes an instrument for alignment and tipping of the cone markers which is situated in front of the lower end of the said conveyor.

A machine according to this invention includes one or two devices for the mechanical placement of cone markers each (device) comprised of a cylindrical gullet flared down and toward the outside and a flexible skirt which is attached around the lower end of the said gullet and is opened towards the back.

The invention has as a result, the placing, the collecting and the intermediate storage of cone markers entirely by mechanical means.

A machine according to the invention operated by only one person is capable of picking up cone markers placed in a line, of storing them and of again placing them in a line, without any manual intervention other than driving and controlling the vehicle.

For collection, a machine according to the invention can pick up cone markers which are slightly out of line since it includes in front a fork which guides the cone markers back into line with the collecting device.

A machine according to the invention includes automatic switches to alert the operator when a magazine being lodded is full or a dispensing magazine is empty such that the operations may be controlled by only one person.

A machine according to the invention increases the safety of road or highway work since it eliminates the operators exposed to accidents. In addition, the vehicle can always run within the cone marked zone in the face of oncoming traffic and thus is already perfectly signaled to them.

When not in a phase of collection or distribution, a vehicle according to the invention is of normal dimensions and no instrument extends beyond these bounds. It may therefore move about freely without danger.

A machine according to the invention includes a micro-switch which detects contact with the cone markers during the collection phase such that the conveyor is started up only when it will be used-to economize energy and to make driving easier for the operator who doesn't need to constantly watch for the presence or absence of cone markers.

The following description refers to the attached drawings which represent, without being in any manner limiting, an example of the embodiment of a machine according to the invention for collecting and distributing of cone markers.

FIGS. 1 and 2 represent a machine to distribute in a line, to store and to pick up cone markers 1 which are used on roads and highways to indicate and demarcate roadworks or obstacles.

The figures represent conical road markers of a current type having a rectangular base 1*a* and a hollow conical point 1*b*. It is emphasized that a machine according to the invention may be used for any hollow conical road marker that will equally be designated "cone marker".

Figure 1:
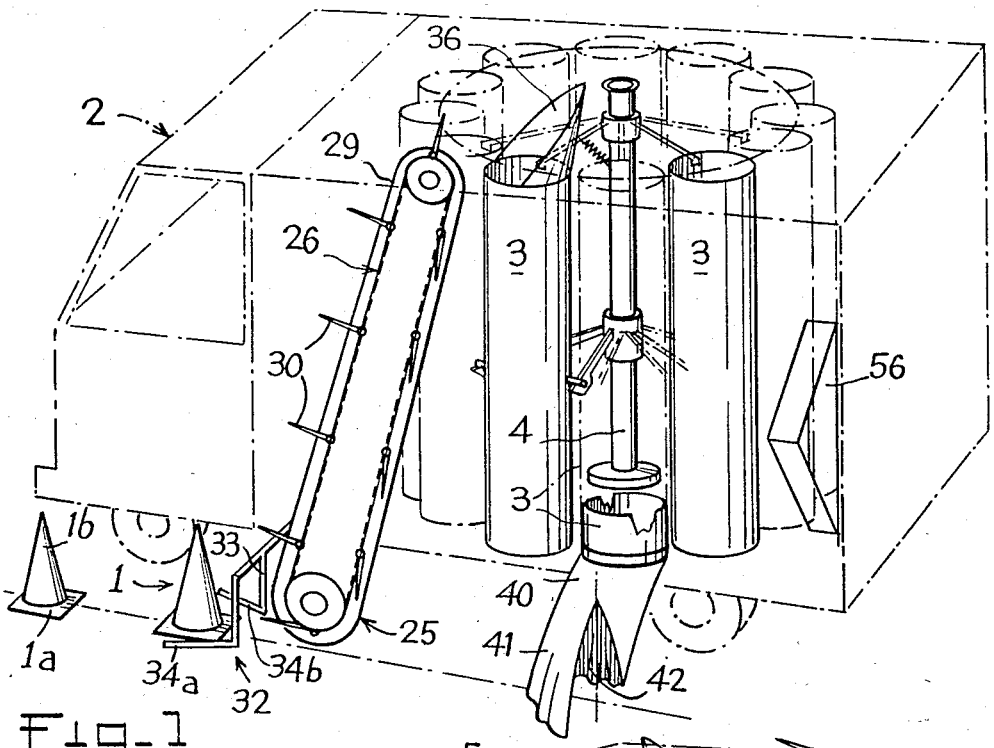
FIG. 1 is a perspective view of the whole.
Figure 2:
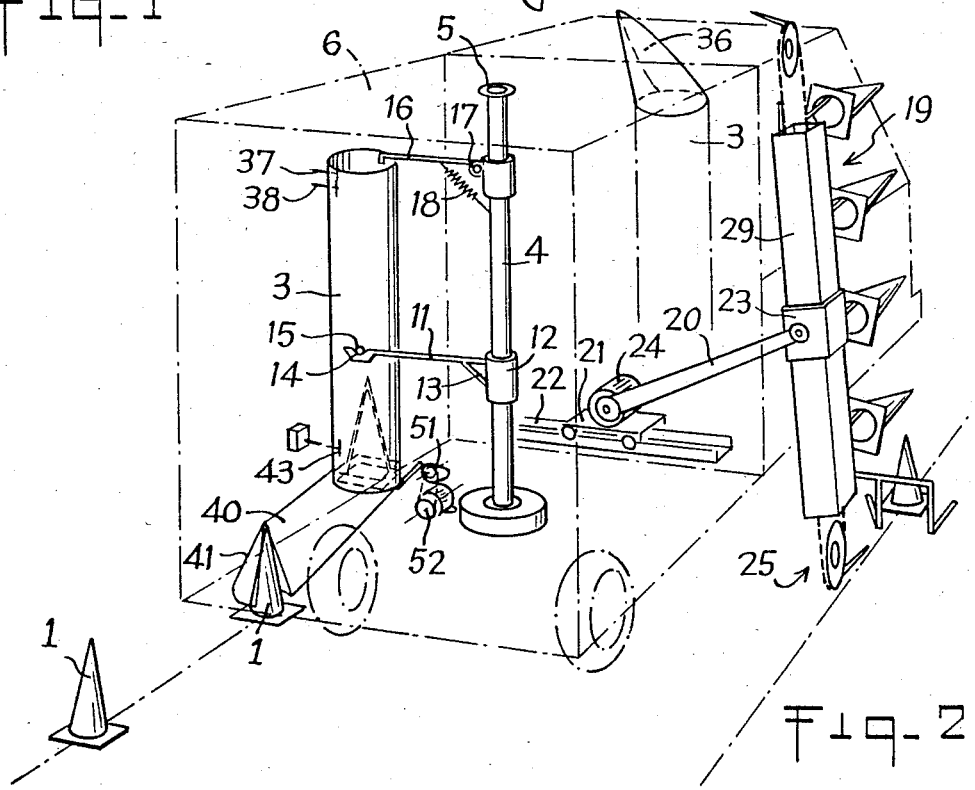
FIG. 2 is a rear view.

FIGS. 1 and 2 represent a motorized vehicle in which the instruments for the collection and distribution of cone markers are mounted on the platform of a motorized vehicle 2. As a variation they may equally be mounted on a trailer towed behind a tractor.

A machine according to the invention is transformable to go from passive transport position to operational position. In the passive transport position, it conforms to standard road vehicle dimensions and no instrument extends beyond these bounds. In the collecting position, the collecting device is situated on one side of the vehicle such that it may move along a line of cone markers picking them up.

It is advantageous that the collection device may be placed either on the right or on the left of the vehicle such that, in every case, the vehicle may be protected by being within the line of cone markers relative to the traffic flow.

This result may well be attained by equipping the vehicle with a collection device mounted on a carriage which moves on a track across the vehicle.

In the distribution phase, the only piece which extends beyond standard road vehicle dimensions is the flexible skirt which guides the cone markers coming out of the gullet so that they may be stood vertically in a line along the vehicles route.

Advantageously a vehicle according to the invention is equipped with two gullets for cone marker distribution situated one on the left and one on the right of the vehicle.

Returning to FIGS. 1 and 2, one sees that the platform of the vehicle or of the trailer carries a magazine for the storage of cone markers which is comprised of vertical cylinders 3, open at both ends. These cone markers are stored vertically in these cylinders in their usual position, that is, base downward, and they are stacked one inside the other.

The interior diameter of the cylinders is slightly greater than that of a circle circumscribed around the base of the cone markers such that these may drop by gravity inside the cylinders being guided by these latter.

Figure 3:
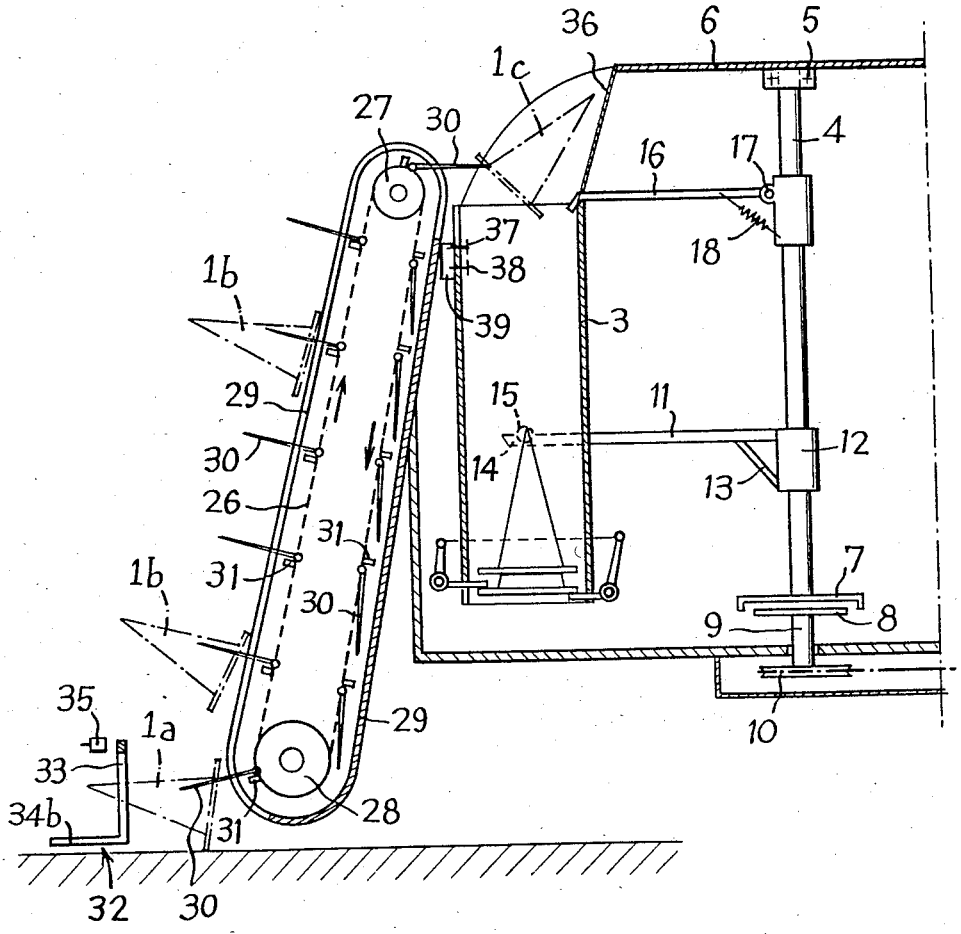
FIG. 3 is an elevation view of the device for collecting cone markers.
Figure 4:
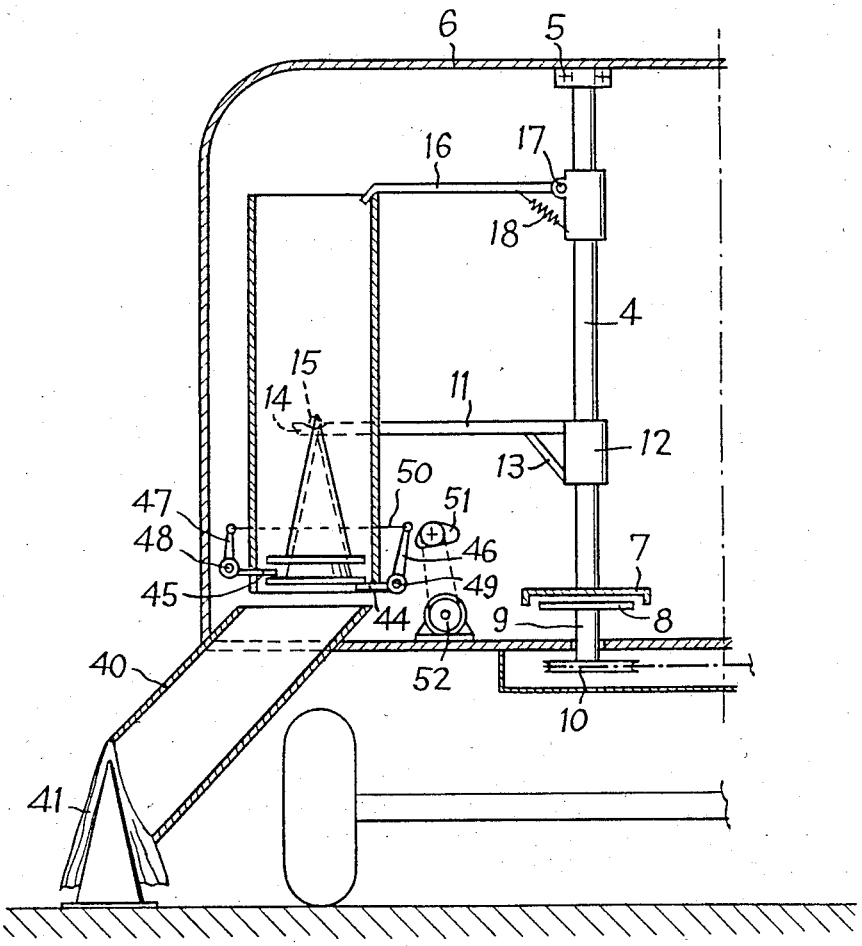
FIG. 4 is an elevation view of the device for distributing cone markers.

The cylinders 3 are distributed around a central vertical shaft 4. The upper end of the shaft 4 is held by a bearing, for example by ball bearings 5 attached to the roof of the body 6 of the vehicle. The lower end of the shaft 4 has a drive plate 7 which rests on a friction pressure plate 8. This plate 8 is driven by a shaft 9 which is, itself, driven by a transmission 10 from a motor not represented. The details of the embodiment of the shaft 4 are represented in FIGS. 3 and 4.

The shaft 4 holds pairs of horizontal arms 11 situated approximately mid-height. These arms are attached for example to a sleeve 12 wedged onto the shaft. The attachment is reinforced by a bracket or strut 13.

The arms 11 have a radial direction. At their free and, they have a cylindrical notch 14. Each cylinder 3 is equipped with two diametrically opposed pivot 15 which rest in the notches 14 of a pair of arms.

The shaft 4 also supports, on its upper part, radial arms 16 which are articulated on yokes with horizontal axles 17 and which are equipped with an elastic device 18, for example a spring, which pulls downward. Each arm 16 rests on the top of a cylinder and presses it downward which maintains the pivots 15 in the notches 14.

Thus the cylinders 3 are easily dismounted. It is sufficient to raise the arms 16 slightly and lift up the cylinder slightly to free the pivots 15 from the notches. This allows, for example the removal from the vehicle of a cylinder full of cone markers to replace it with an empty cylinder or vice versa.

A vehicle according to the invention could include for example twelve cylindrical magazines 3 distributed within a cylindrical volume of 2.4 meters in diameter. Each cylinder has for example a height of the order of 2 meters and could contain twenty-five cone markers.

The motor driving the shaft 4 causes it to turn stepwise, each step corresponding to the angular distance between two adjacent magazines, such that after each step each cylinder occupies exactly the place where previously the cylinder which preceded it was. Thus the shaft 4 and the cylinders 3 form a transfer carrousel permitting the interchange of the cylindrical magazines 3.

For the clarity of the drawings only a few cylindrical magazines have been represented on FIG. 1 and only one on FIGS. 2 and 4.

A vehicle according to the invention includes at least one device for the mechanical collection of the cone markers.

As a variation, it may include two collection devices situated in one part or another of the vehicle.

Advantageously, as can be seen on FIG. 2, it includes only one collection device 19 which is held by one or two transversal arms 20 mounted on a carriage 21 which moves along a track across the vehicle or is situated in the center of the vehicle. The two arms 20 are articulated on a collar 23 supporting the collection device. They are driven in rotation by a motor 24 or by a jack.

The rotation of the arms allows the raising of the collection device and at the same time to fold it up into the interior of its standard vehicle dimensions for road travel. Conversely, the collection device may be brought out and lowered such that the bottom of the device is slightly above ground level during the phase of collecting the cone markers.

According to one embodiment, the length of the arms 20 is slightly greater than half of the width of the vehicle and, in this case, the rotation of the arms is enough to move the collection device from one side to the other of the vehicle.

As a variation, the arms 20 are shorter and, in this case, are mounted on a carriage 21 with can move from side to side on a track 22 across the vehicle.

The collection device includes a conveyor 25 which is composed of a closed chain 26 which runs over two cogwheels 27 and 28 one of which is the drive wheel, for example the lower one 28. Preferably, the upper wheel 27 has a smaller diameter than the lower wheel 28, such that the angular speed of the upper wheel 27 is greater in order to facilitate the ejection of the cone markers by centrifugal force.

Details of the embodiment of the collection device appear in FIG. 3.

The chain conveyor is enclosed within a chain guard 29. The axles of the cogwheels 27 and 28 are transverse. The conveyor is situated parallel to the direction the vehicle moves and at its top is tilted in toward the vehicle. The front half of the chain ascends.

The chain 26 has projections 30 which are articulated on the chain and the stops 31 which maintain each projection 30 in a position approximately perpendicular to the chain when ascending. The front face of the chain guard has a longitudinal slot from which the projections 30 on the chain emerge.

FIG. 3 shows that, on the downside, the projections fall back along the chain by gravity and remain within the chain guard.

The lower part of this guard 29 is made such that each projection 30 assumes an approximately horizontal position as it emerges from the lower end of the slot in the chain guard.

Thus, as the vehicle moves forward, the projection 30 nearest the ground penetrates the interior of the overtipped cone marker 1 as shown on FIG. 3.

Note that if the cone marker is tipped over before a projection has emerged, it is pushed along by the chain guard until a projection arrives to pick it up.

The collection device also includes at its lower end and in front of the conveyor an instrument 32 which aligns and tips over the cone markers and is comprised of a crossbar with uprights 33 situated in a transverse plane to the vehicle and a fork formed of two horizontal arms **34*a*, 34*b* which project from lower end of the crossbars vertical members, one straight ahead, one diverging slightly. The arms 34*a*, 34*b* move slightly above the ground. Their function is to funnel the cone markers into line with the conveyor. The horizontal member of the crossbar unit is situated at a height slightly lower than that of the cone markers. It strikes the top of the cone markers and tips them over top forward and the opening in the base directed backward such that the projections 30** may penetrate into the cone markers. The width of the crossbar unit it greater than the side of the square base of the cone markers.

FIG. 3 shows that the upper bar of the crossbar unit 33 includes a micro-switch 35 which detects each contact with a cone marker and which sends an impulse which automatically switches on the motor which drives the cogwheel 28. A signal for the end of a run automatically stops this motor after bringing the last projection 30 into the position where it could engage a cone marker.

FIG. 3 shows an overtipped cone marker 1*a* into which a projection 30 is engaging, two cone markers 1*b* being hauled up by the conveyor, and one cone marker 1*c* which has just been ejected by a projection 30 going over the wheel 27.

FIG. 3 also shows a cylindrical magazine 3 in position to receive the cone markers. The open upper end of the magazine is surmounted by an inclined gullet 36 which is open toward the front and which may advantageously be joined to an opening cut in the body 6 of the vehicle. The ejected cone marker strikes the gullet and slides along it to fall vertically into the receiving cylinder 3.

In FIG. 3 each cylinder includes two buttons 37 and 38 one above the other near the upper end of the cylinder to indicate when a magazine is full and should be replaced by another.

When the cylinder is in filling position, the two buttons are positioned opposite two electrical contacts which are situated in a box attached to the bodywork and which are mounted in series or are connected to a logical AND gate.

When a cone marker falls down the cylinder, it closes first one then the other of the two contacts. When the magazine is full, both contacts are closed simultaneously. The logic gate, for example an AND gate then emits a signal which sends a warning to the operator indicating that the vehicle should be stopped temporarily. At the same time, the signal automatically causes the motor which drives the shaft 4 to start advancing the carrousel one step to bring a new, empty magazine into filling position.

A machine according to the invention includes a device for the mechanical distribution of cone markers along a line. It is composed of a rigid, cylindrical, transverse gullet 40 situated on the side of the body and inclined downward and toward the exterior.

The upper end of the gullet is situated in a horizontal plane. The gullet has a diameter equal to or slightly greater than the diameter of the cylinders 3. The magazine to be unloaded is positioned coaxially (directly) over the upper opening of the gullet. The other end of the gullet is situated approximately in the same vertical plane as the outer edge of the body so that the gullet does not extend beyond the perimeter of the vehicle. This gullet is elongated by a flexible skirt 41 which surrounds the end of the gullet and which includes an opening 42 directed toward the back.

When there is no cone marker in the gullet, the flexible skirt folds in and hangs at the end of the gullet. When a cone marker is released from the magazine, it falls through the gullet and pushes against the skirt which keeps it upright. As the vehicle advances, the cone marker placed on its base emerges from the skirt through its back opening 42. Each cylindrical magazine includes a button to signal the end of the run 43 situated near the lower end of the cylinder.

The unloading bay includes, above the gullet 40, an electrical contact attached so as to relate to the button 43 when it is positioned.

When the last cone marker has left the magazine, the button 43 activates the said electrical contact which signals the operator to temporarily stop the vehicle to change the magazine. At the same time, the signal emitted by the electrical contact starts the motor driving the shaft 4 to advance one step and place a full magazine over the gullet 40.

Each cylindrical magazine 3 includes, at its lower end, two stops 44 and 45 situated at two different levels to release cone markers one by one. These two stops may for example be semi-circular and are situated on either side of the cylinder. They are mechanically linked such that one is pulled out of the way while the other is engaged within the cylinder and vice versa. For example, the two stops are each attached to a lever 46, 47 which is articulated around a horizontal axle 48, 49 and the two levers are linked to each other by a rod 50. Thus when the lower stop 44 is withdrawn, the bottom cone marker can drop into the gullet while the other cone markers are retained by the other stop 45 which is engaged below the next cone marker up (second from the bottom).

The unloading bay includes a cam 51 which is driven step by step by a motor 52. When the cam turns, it presses against the lever 46 which pulls back the lower stop 44 and releases the bottom cone marker.

The vehicle is equipped with a distance counter which measures the distance run by the vehicle. It is also equipped with a keyboard or any other equivalent means of programming which permits the operator to program the spacing between cone markers which may vary for example between 1 m and 25 m.

A comparator compares the measured distance with the programmed spacing and controls the switching on of a motor 52 which drives, each time, the cam 51 to take a turn, which has the effect of releasing one cone marker.

FIG. 2 represents a vehicle having only one distribution gullet 40 situated on the left side of the vehicle. As a variation, the same vehicle advantageously includes two identical unloading bays situated one on the left and one on the right of the vehicle. When the vehicle places a string of cone markers on a highway, they may be placed to delineate a protected strip situated either on the right or the left of a lane.

A vehicle which can distribute to the left or right can remain always within the protected zone of cone markers already layed down.

FIG. 1 represents a vehicle 2 which includes, at the back, signalization panels 56 which are deployed on the side of the vehicle where the collection device 25 is, in order to indicate the latters presence.

Figure 5:
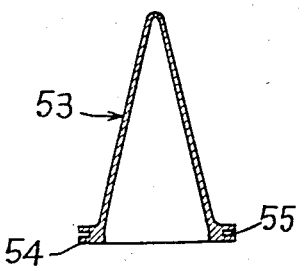
FIGS. 5 and 6 are a cross-section and a view from underneath of a cone marker adapted to a machine according to the invention.
Figure 6:
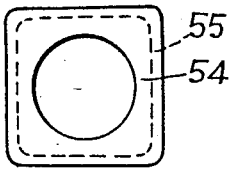

FIGS. 5 and 6 represent a cross-section and an underneath view of a cone marker 53 which includes a rectangular base 54 in the thickness of which is a peripheral groove 55 or notches into which penetrate one or several projections of the stops 44, 45 within the cylinders 3 to hold back the cone markers inside the cylinders. This embodiment of the cone markers facilitates the construction of the stops 44 and 45.

What is claimed is:

1. A machine for mechanically picking up, storing and transporting hollow conical road markers, said machine being mounted on a vehicle, comprising a plurality of vertically supported cylindrical containers, each being open at both ends, a vertical shaft rotatably supported on said vehicle, a plurality of arms extending radially outwardly from said vertical shaft and supporting said container, a conveyor-elevator means extending downwardly from said vehicle, just above a road surface, for picking up the road markers when the vehicle moves along a line of road markers, said conveyor-elevator means including a driven continuous chain, a plurality of spaced articulated projections supported on said chain, and aligning and tipping-over means for directing a base of each road marker for engagement with one of said projections on said chain, whereby each marker is picked up by one of said projections and moved by said chain for deposit in a selected container.

2. The machine according to claim 1, wherein the said conveyor-elevator means are disposed within a chain guard which has, in front along its full height, a slot through which emerge the said projections attached to the ascending portion of the chain.

3. A machine according to claim 1, wherein said means for aligning and tipping over comprises a horizontal crossbar and two uprights situated in a plane transverse to the vehicle, and a fork formed of two horizontal arms which project forwardly from lower ends of said uprights and which arms diverge forwardly of the vehicle.

4. A machine according to claim 3, including at least one transverse arm having one end coupled to said conveyor-elevator means, a motor operatively coupled to the other end of said transverse bar, whereby said motor and said transverse bar are adapted to move said conveyor-elevator means into the interior and exterior of said vehicle for pick up of markers or for normal travel.

5. The machine according to claim 4, wherein the said arm and the motor are supported by a carriage which moves on a track across the vehicle in order to shift the conveyor-elevator means from one side of the vehicle to the other.

6. The machine according to claim 1, wherein each cylindrical container includes, near its upper end, two buttons, one above the other, which buttons are positioned relative to two electrical contacts when the said container is in loading position and the said contacts are connected in series with an AND circuit which emits a signal when the container is full, and each container also includes, near its lower end, a button which relates to a contact when the container is in position for unloading, which contact emits a signal when the container is empty and said signals activate an alarm which alerts an operator and also controls the automatic switching on of the motor driving the said vertical shaft.

7. The machine according to claim 3, including at least one device for the mechanical placement of cone markers which device is composed of a cyclindrical gullet inclined outwardly and downwardly, and a flexible skirt which is attached around the lower edge of the said gullet, said skirt having an opening facing the rear of the vehicle.

8. The machine according to claim 7, wherein each container includes, at its lower end, two stops, one above the other, which stops engage respectively under the bottom and the second-to-bottom cone markers, which stops are activated by articulated levers which are connected one to the other by a rod such that when the lower stop is pulled back and allows a cone marker to fall, the upper stop is engaged beneath the second-to-bottom cone marker and vice versa.

9. A machine according to claim 3, including a microswitch cooperatively mounted on said crossbar, a motor for driving said conveyor-elevator means, said microswitch, when it detects contact with a cone marker, energizing said motor for actuating said conveyor-elevator means.

10. A process for mechanically picking up and storing hollow conical road markers with a vehicle which is equipped with a conveyor-elevator, with vertical hollow containers and with an inclined gullet situated above said containers comprising the following steps:

moving said vehicle along a line of standing and overturned cone markers;

aligning said markers and tipping forward the standing markers;

picking up each marker and conveying upwardly said marker into the interior of said vehicle;

ejecting said conveyed marker in its topmost position against said inclined gullet, and directing said ejected marker gravitationally into a selected container.

* * * * *